US010711534B2

(12) United States Patent
Crowley et al.

(10) Patent No.: US 10,711,534 B2
(45) Date of Patent: Jul. 14, 2020

(54) STABILIZER FOR A STEERABLE DRILLING SYSTEM

(71) Applicant: Smart Stabilizer Systems Limited, Tewkesbury (GB)

(72) Inventors: James Crowley, Tewkesbury (GB); Robert Sedgeman, Tewkesbury (GB); David Willcox, Tewkesbury (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 25 days.

(21) Appl. No.: 15/765,580

(22) PCT Filed: Nov. 7, 2016

(86) PCT No.: PCT/GB2016/053481
§ 371 (c)(1),
(2) Date: Apr. 3, 2018

(87) PCT Pub. No.: WO2017/077347
PCT Pub. Date: May 11, 2017

(65) Prior Publication Data

US 2018/0298700 A1 Oct. 18, 2018

(30) Foreign Application Priority Data

Jun. 11, 2015 (GB) ..... 1519636.3

(51) Int. Cl.
*E21B 17/10* (2006.01)

(52) U.S. Cl.
CPC ..... *E21B 17/1078* (2013.01)

(58) Field of Classification Search
CPC ..... E21B 17/1078
See application file for complete search history.

(56) References Cited

U.S. PATENT DOCUMENTS 4,467,879 A 8/1984 Burge
6,983,811 B2 * 1/2006 Wardley ..... E21B 17/14 175/402

(Continued)

FOREIGN PATENT DOCUMENTS

GB 2166177 A 4/1986
WO 96/28635 A 9/1996

OTHER PUBLICATIONS

Int'l Search Report and Written Opinion in counterpart PCT Appl. PCT/GB2016/053481, dated Feb. 28, 2017, 6-pgs.

*Primary Examiner* — Giovanna C Wright
*Assistant Examiner* — Brandon M Duck
(74) *Attorney, Agent, or Firm* — Blank Rome, LLP

(57) ABSTRACT

This invention relates to a stabilizer (10) for a steerable drilling system, in particular for use in drilling directional boreholes for oil and gas extraction. There is provided a stabilizer (10) for a steerable drilling system having a first passageway (16) and a second passageway (18) at its outer surface, the passageways being helical and extending along the length of the stabilizer, the first and second passageways being oppositely-oriented, the first and second passageways intersecting one another, the stabilizer having a number of blades (22) between the passageways, the cross-sectional area of the first passageway being larger than the cross-sectional area of the second passageway. The asymmetric passageways enable the stabilizer designer to enhance the performance of the stabilizer during drilling and tripping.

9 Claims, 3 Drawing Sheets

(56) References Cited

U.S. PATENT DOCUMENTS

| | | | | |
|---|---|---|---|---|
| 2005/0257934 | A1* | 11/2005 | Baird | E21B 10/26 166/380 |
| 2009/0314486 | A1 | 12/2009 | Castro | |
| 2015/0129309 | A1* | 5/2015 | Anderson | E21B 17/1057 175/57 |

* cited by examiner

STABILIZER FOR A STEERABLE DRILLING SYSTEM

FIELD OF THE INVENTION

This invention relates to a stabilizer for a steerable drilling system, in particular for use in drilling directional boreholes for oil and gas extraction.

DESCRIPTION OF THE PRIOR ART

To extract oil and gas from underground reserves, it is necessary to drill a borehole into the reserve. Traditionally, the drilling rig would be located above the reserve (or the location of a suspected reserve) and the borehole drilled vertically (or substantially vertically) into the reserve. The reference to substantially vertically covers the typical situation in which the drill bit deviates from a linear path because of discontinuities in the earth or rock through which the borehole is being drilled.

Steerable drilling systems have been developed to drill directional boreholes, i.e. the steerable drilling system allows the determination of a path for the drill bit to follow which is non-linear. It is therefore possible to drill to a chosen depth and then to steer the drill bit along a curve until the drill is travelling at a desired angle, and perhaps horizontally. Steerable drilling systems therefore allow the recovery of oil and gas from reserves which are located underneath areas in which a drilling rig could not be located.

To facilitate drilling operations, a drilling fluid (called "mud") is pumped into the borehole. The mud is pumped from the drilling rig through the hollow drill string, the drill string being made up of pipe sections connecting the drill bit to the drilling rig. The mud exits the drill string at the drill bit and serves to lubricate and cool the drill bit, as well as flushing away the drill cuttings. The mud and the entrained drill cuttings flow to the surface around the outside of the drill string, specifically within the annular region between the drill string and the borehole wall.

To allow the mud to return to the surface, the drill string is of smaller cross-sectional diameter than the borehole. In a 6 inch (approx. 15 cm) borehole, for example, the outer diameter of the downhole assembly (i.e. the assembly of tools behind the drill bit) will typically be 4.75 inches (approx. 12 cm), with the majority of the drill string comprising drill pipe sections of smaller diameter.

It is necessary to stabilize such a drill string, i.e. during drilling (when the drill string rotates) the gap between the drill string and the borehole wall allows the drill string to move transversely relative to the borehole, possibly causing vibrations within the drill string, damage to the drill string and/or borehole, and/or lack of uniformity in the cross-section of the borehole. To avoid this uncontrolled transverse movement, stabilizers are included at spaced locations along the length of the drill string, the stabilizers having a diameter slightly less than the diameter of the borehole. It is particularly necessary to locate stabilizers near to the drill bit in a steerable drilling system so that the position and orientation of the drill bit can be better controlled.

To allow the passage of mud back to the surface, the stabilizers have blades (borehole-engaging surfaces) which engage the borehole wall and passageways between the blades. The blades (and consequently the passageways) may be linear or helical.

It is recognized that increasing the clearance between the stabilizer blades and the borehole wall increases the likelihood of vibration within the drill string and the downhole assembly, which vibrations can be damaging if unchecked. One possible effect is known as "backwards whirl", where the drill bit undergoes a complex path of movement around the borehole which is potentially damaging.

Many steerable drilling systems incorporate positive displacement motors (e.g. mud motors). The stabilizers used in such systems, particularly those close to the drill bit, have blades which are typically ⅛ inch (approx. 3 mm) smaller than the borehole. ⅛ inch is a relatively large clearance but a mud motor is typically sufficiently mechanically simple and robust to accommodate the vibrations which are induced during use, and is not be likely to suffer damage or undue wear as a result.

Other steerable drilling systems use one or more actuators to drive the drill string out of alignment with the borehole axis, and thereby cause the drill bit to deviate from a linear path. A steering tool for use in one such drilling system is described in EP 1 024 245. These steerable drilling systems are typically more mechanically complex than positive displacement motors and are more liable to suffer damage caused by uncontrolled downhole vibrations. The requirement to minimize vibration and uncontrolled downhole dynamics in such systems requires the stabilizers (especially those located near to the drill bit) to be of a size which is very close to borehole diameter (for example 1/32 inch (approx. 0.8 mm) less than the diameter of the borehole). Also, the blades of the stabilizer must usually be helical and overlapping so that they provide a continuous circumference, i.e. 360° borehole contact, which promotes smooth "bearing like" operation when rotating.

However, reducing the clearance between the stabilizer blades and the borehole increases the likelihood of the stabilizer becoming stuck in the borehole. Stuck-in-hole incidents are extremely costly to operators and to the service companies providing the downhole tools.

A particular concern arises when drilling through salt formations and the like, such formations being known to swell after being drilled. If the swelling is sufficient the formation can hinder or prevent the passage of a stabilizer and/or the downhole tools when pulling the drill string out of the borehole.

As extended reach drilling activity increases there is a general increase in the number of stabilizers required along the length of the drill string. However, some operators wish to minimize the number of stabilizers in the hope of reducing the likelihood of stuck-in-hole incidents. Drill operators and service companies must therefore balance the requirement to provide an appropriate number of stabilizers to avoid damaging vibrations and other deleterious effects for a given drill string, and minimizing the likelihood of stuck-in-hole incidents.

EP 0 178 709 discloses a stabilizer to be mounted immediately behind the drill bit, the stabilizer having a number of helical blades and helical passageways between the blades. At least one circumferential channel, which is shallower than the passageways, is formed through the blades to interconnect the passageways, the channel being provided to minimize the deviation of the orientation of the drill bit during use.

U.S. Pat. No. 4,467,879 discloses a stabilizer having a number of "clockwise" helical passageways and a number of "anticlockwise" helical passageways, the respective passageways intersecting and defining diamond-shaped borehole-engaging blades therebetween. The blades provide a continuous circumference (i.e. 360° borehole contact). The benefit of the oppositely-directed passageways is stated to be to minimize the obstruction to mud flow past the stabilizer.

SUMMARY OF THE INVENTION

The present invention provides a stabilizer for a steerable drilling system having a first passageway and a second passageway at its outer surface, the passageways being helical and extending along the length of the stabilizer, the first and second passageways being oppositely-oriented, the first and second passageways intersecting one another, a number of blades between the passageways, the blades together providing a continuous circumference, the cross-sectional area of the first passageway being larger than the cross-sectional area of the second passageway.

Accordingly, the stabilizer has passageways comprising two helix profiles of opposite orientations. Preferably, the depth of the first passageway and the depth of the second passageway are substantially identical so that the different cross-sectional areas arise because of the different widths of the first and second passageways. The different widths of the passageways generate a "parallelogram like" blade profile, the blades overlapping to provide 360° borehole contact.

Preferably, the combined cross-sectional area of the passageways exceeds the combined cross-sectional area of the blades, so that the stabilizer provides an open area for mud flow of at least 50% of the total annular area available. Alternatively stated, a notional circumferential ring placed anywhere along the stabilizer will alternately span the passageways and the blades, and the total circumferential length of the passageways which is spanned by the ring will exceed the total circumferential length of the blades which is spanned. Ideally, the open area is around 60%.

The stabilizer offers multiple flow paths along which the mud can flow. The multiple flow paths enable an increased flow rate and increased solids (including cuttings) mobilization, reducing the likelihood of the stabilizer collecting cuttings and packing-off in the borehole. Thus, the mud which must pass the stabilizer on its path back to the surface contains a high proportion of solids, including in particular drill cuttings. It is necessary to keep the mud moving in order to reduce the likelihood of settlement of the cuttings (and other solids). The settlement of solids within the borehole is known as a "pack-off". A pack-off can occur adjacent to the stabilizer (typically immediately uphole of the stabilizer) and is known to increase the likelihood of a stuck-in-hole incident. A pack-off can also occur within a passageway of the stabilizer and will reduce the area available for mud to flow back to the surface, which in turn can increase the likelihood of further solids settlement adjacent to the stabilizer.

The asymmetrical profile which the differing first and second passageways provide has been found to maximize the flow path for mud (and for solids transport) while the stabilizer is rotating. Also, the profile has been found to reduce the "pump back" effect which occurs when a stabilizer with helical blades is lifted into a bed of static solids. The pump back effect is known to cause beds of static solids to increase in profile and to contribute to stuck-in-hole incidents.

Importantly also, the asymmetric profile permits clear flow paths for cuttings when tripping, i.e. when pulling the drill string out of the borehole. Thus, during tripping the drill string will typically be rotated so as to allow the stabilizers and downhole tools more easily to pass any obstructions within the borehole and thereby minimize the likelihood of the drill string becoming stuck in the hole. It is only possible to rotate the drill string in one direction, typically clockwise when looking downhole. Whilst the clockwise passageway will face the direction of rotation during drilling, the anti-clockwise passageway will face the direction of rotation during tripping. It will be understood that with a conventional helical stabilizer it is not possible to provide a flow path facing the direction of rotation during drilling and also during tripping.

In the context of the present application, it will be understood that reference to a given passageway facing the direction of rotation means that a line directed along the passageway at the leading end of the passageway has a component aligned with the direction of rotation.

It is recognized that during use mud will flow along both of the first and second passageways. The inventors have realized that it is possible to utilize an asymmetric profile to control the flow rate of mud through the stabilizer during drilling and tripping, and importantly to provide different fluid velocities through the stabilizer when drilling and tripping, with consequential benefits in drilling performance.

Specifically, the inventors have realized that the flow of mud through the stabilizer passageways is governed by two effects. The primary effect is that a larger proportion of the total volumetric mud flow tends to pass along the passageways facing the direction of rotation and a smaller proportion tends to flow along the passageways facing away from the direction of rotation. The secondary effect is that more mud will tend to flow along a passageway with a larger cross-sectional area. The inventors appreciate that the drill string, and therefore the stabilizers, will rotate in the same direction during drilling and tripping, and so the passageway facing/facing away from the direction of rotation changes between drilling and tripping. These primary and secondary effects act in combination or in opposition depending upon whether the drill string is drilling or tripping.

A stabilizer designer can choose the total cross-sectional area of each of the passageways, and therefore their relative cross-sectional areas, as well as the helix angle of each of the first and second passageways. By choosing these parameters, the designer can determine the relative significance of the primary and secondary effects for a particular stabilizer. It is expected that in most applications the parameters will be chosen so that primary effect dominates the secondary effect, i.e. a larger proportion of the mud will in practice flow along the passageway facing the direction of rotation during both drilling and tripping.

Preferably, the passageway facing the direction of rotation when drilling is the first (larger) passageway. This means that the passageway facing the direction of rotation when tripping is the second (smaller) passageway. The primary and secondary effects therefore combine together during drilling and both result in a larger proportion of the mud flowing along the first (larger) passageway. However, the primary and secondary effects oppose during tripping, with the dominant primary effect resulting in a larger proportion of the fluid flowing along the smaller-area passageway during tripping.

The flow velocity of the mud along the respective passageways depends upon the volumetric flow rate along a passageway and the cross-sectional area of the passageway. Also, the turbulence in the mud within the passageways is dependent upon flow velocity. The different volumetric flow rates and the different cross-sectional areas of the respective passageways determines the relative flow velocities and the maximum flow velocity, during both drilling and tripping. It will be understood that when the larger proportion of the mud flow is through the first (larger) passageway the maximum flow velocity is lower than when the larger proportion of mud flow is through the second (smaller) passageway.

The inventors utilize the differing volumetric flow rates, and the consequential different maximum flow velocities, to enhance the stabilizer performance during drilling and tripping.

In particular, it can be arranged that the maximum flow velocity of mud through the stabilizer when drilling is lower than the maximum flow velocity when tripping. The turbulence generated within the drilling fluid is related to the flow velocity and reducing the maximum flow velocity during drilling is a particularly desirable feature since it reduces the likelihood of downhole vibrations being caused (or sustained) by turbulence within the drilling fluid.

When tripping, however, the effect of vibrations is less significant, and the most important attribute of the stabilizer is to maximize the flow velocity so as to maximize turbulence within the drilling fluid and minimize the likelihood of settlement of the solids.

Because the first and second passageways intersect, significant turbulence is generated within the mud at the intersections, resulting in localized changes in the flow velocity and pressure, each of which helps to mobilize the solids. The turbulence which is generated depends upon the flow velocity along the passageways.

Preferably, the difference in the cross-sectional areas of the first and second passageways results in a difference in the flow velocity of the mud flowing along the first and second passageways of at least 30%, ideally at least 40% and preferably around 45% in use. Tests have shown that a flow velocity difference of 45% provides an optimal level of turbulence to encourage solids mobilization without limiting the overall flow rate of mud past the stabilizer. Tests have also shown that if the flow velocity in a passageway (typically the narrower second passageway) is too high, eddy currents are generated within the mud which limits the overall flow rate of mud past the stabilizer.

It is also understood that during use of a conventional stabilizer with a number of helical passageways facing the direction of rotation when drilling, all of the passageways act to drive the solids uphole during rotation of the drill string, i.e. the helical blades act like an Archimedes screw to lift the mud and the entrained solids. Some of the solids can settle immediately uphole of the stabilizer and the settled solids can build up over time to cause a pack-off. With the present invention, on the other hand, whilst any solids which have settled in the first passageway(s) are driven uphole, those solids which have settled in the second passageway can be driven towards the drill bit as the stabilizer rotates. These downwardly-moving solids will be driven to the intersections where the first and second passageways meet, where they will be further mobilized by the turbulence and entrained into the mud and carried uphole.

It is another benefit of the present invention that if a part of one passageway does become blocked by solids, there are alternative (multiple) flow paths along which the mud can flow to the surface. A pack-off incident is therefore less likely to block all of the passageways across the stabilizer.

Preferably, the side walls of the blades at the ends of the stabilizer taper towards each other so as to present a sharp leading end. A sharp leading end will minimize the likelihood that any of the solids are driven radially outwards towards the small clearance gap between a blade and the borehole wall, and will instead be driven sideways towards the first or the second passageway.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
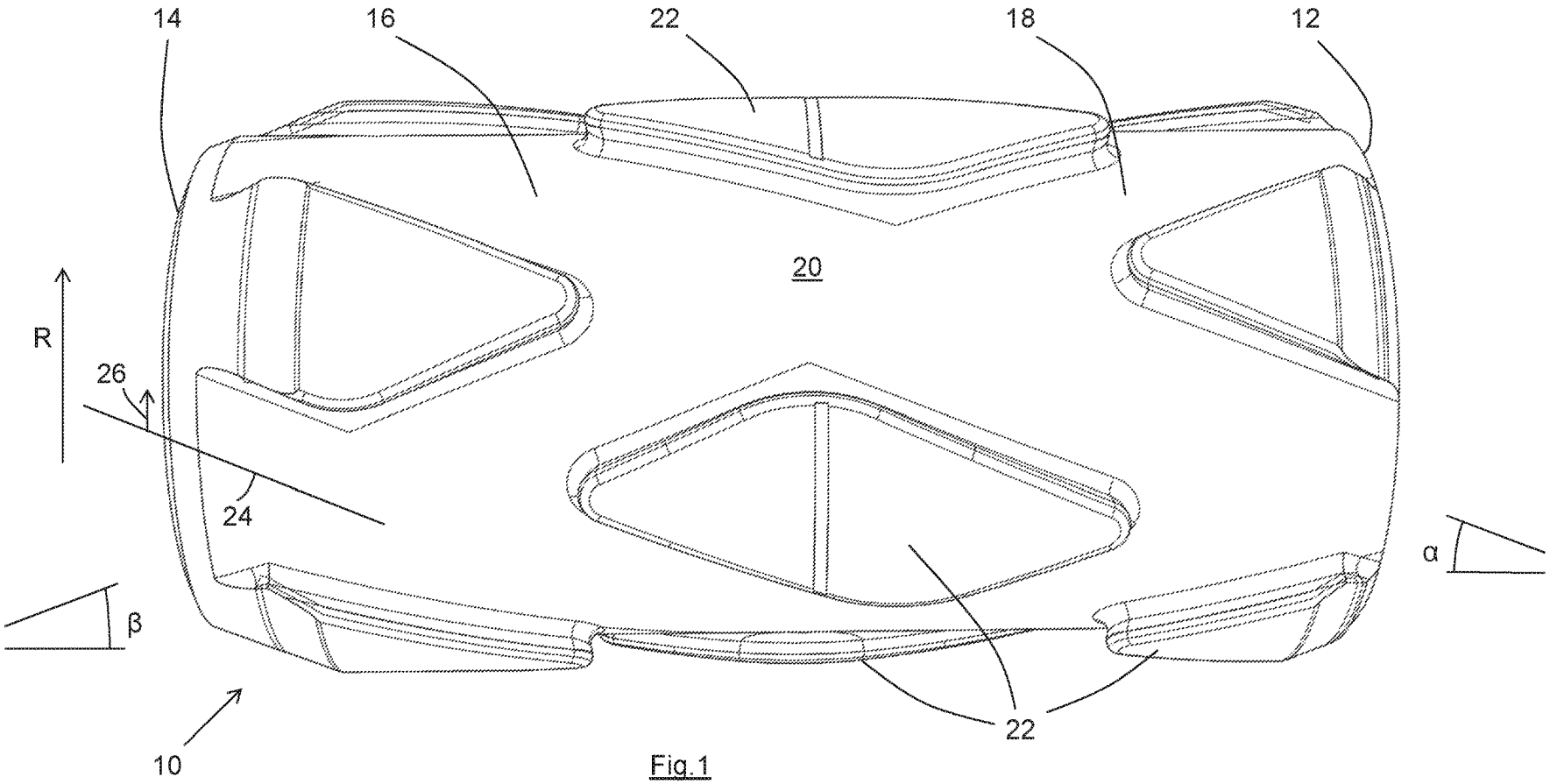
FIG. 1 shows a side view of the stabilizer according to the present invention.

The stabilizer 10 is designed to fit into a drill string (not shown), ideally close to the drill bit as part of the downhole assembly of a steerable drilling system (also not shown). The stabilizer 10 is tubular so that mud can flow towards the drill bit through the stabilizer. The tubular ends of the stabilizer have threaded connectors (not shown) by which the stabilizer may be securely connected to other parts of the drill string or downhole assembly, in known fashion.

The stabilizer 10 has an uphole end 12 and a downhole end 14. The respective connectors at each end 12, 14 ensure that the stabilizer 10 can only be fitted in the correct orientation (with the downhole end 14 facing towards the drill bit and the uphole end 12 facing towards the surface).

The outer part of the stabilizer 10 has a number of helical passageways 16, 18 which extend along the length of the stabilizer. The stabilizer has at least one first passageway 16 and at least one second passageway 18, the first and second passageways being oppositely-oriented. In this embodiment the first passageway is oriented clockwise, in that when viewed from the uphole end 12 the first passageway 16 rotates clockwise along its length from the uphole end 12 to the downhole end 14 of the stabilizer 10. The second passageway 18 is oriented anti-clockwise.

In this embodiment there are four (substantially identical) first passageways 16 equally spaced around the periphery of the stabilizer 10, and similarly there are four (substantially identical) second passageways 18 also equally spaced around the stabilizer. The helix angle $\alpha$ of the first passageways 16 and the helix angle $\beta$ of the second passageways 18 are identical in this embodiment and that is the preferred arrangement. It will be understood that in less preferred embodiments the helix angles $\alpha$ and $\beta$ are not identical. It is also not essential that the numbers of first and second passageways 16, 18 are the same.

The first and second passageways 16, 18 cross or join at intersections 20, and define a number of blades 22.

Importantly, the blades 22 together provide a continuous circumference, in that when viewed from the end the outer periphery of the stabilizer 10 is formed by successive blades, with the diameter of the blades being slightly smaller than the diameter of the borehole being drilled, so as to provide the (small) clearance desired between the stabilizer 10 and the borehole in use. Thus, when viewed from the end of the stabilizer 10 the blades 22 overlap so as to provide 360° borehole contact.

The cross-sectional area of each of the first passageways 16 is larger than the cross-sectional area of each of the second passageways 18. It will be observed from FIG. 1 that the depth of the passageways 16, 18 is the same (i.e. there is no step at the intersections 20). The difference in cross-sectional areas therefore arises because of the different widths of the respective passageways. The width W1 of the first passageways is preferably between two and three times greater that the width W2 of the second passageways.

It will be observed that the different-width passageways 16, 18 together create generally parallelogram-shaped blades 22. The blades are rounded at their corners to minimize undue wear at these locations. In this embodiment only the blades at the center of the stabilizer 10 are complete, with the blades at the ends of the stabilizer being truncated. In this embodiment, therefore, the distance between the uphole end 12 and the downhole end 14 is too short to accommodate additional complete blades, but it will be understood that in other (longer) stabilizers there may be two (or more) rows of complete parallelogram-shaped blades.

It will be understood that a conventional drill string is designed to rotate clockwise when looking downhole. During drilling the drill bit increases the length of the borehole and the stabilizer 10 moves towards the left as drawn in FIG. 1. The downhole end 14 is therefore the leading end of the stabilizer 10 during drilling.

During drilling, therefore, the first passageways 16 face the direction of drilling, i.e. a line 24 directed along the first passageway 16 at the leading end 14 has a component 26 aligned with the direction of rotation R of that part of the end 14. Similarly, a line directed along the second passageway 18 at the leading end 14 has a component opposing the direction of rotation R.

When the drill string is pulled from the borehole (tripping), however, the uphole end 12 is the leading end of the stabilizer 10. During tripping the second passageways 18 face the direction of rotation R.

When mud is being pumped to the drill bit, the mud together with entrained drill cuttings flows back to the surface along the passageways 16, 18. There is mud flow through all of the passageways 16, 18, the combined volumetric flow rate through all of the passageways 16, 18 equaling the total volumetric flow rate of mud back towards the surface.

The passageways facing the direction of rotation R dominate the flow of drilling fluid, in that the larger proportion of the total flow rate passes along the passageways facing the direction of rotation and the smaller proportion flows along the passageways facing away from the direction of rotation. This primary (direction of rotation) effect is combined with a secondary (area) effect, namely that more fluid will tend to flow along the passageways with the larger cross-sectional areas.

By arranging the first (larger-area) passageways 16 to have a clockwise orientation, the first passageways face the direction of rotation R during drilling, and the primary and secondary effects combine during drilling, i.e. more fluid flows along the first passageways 16 during drilling both because those passageways face the direction of rotation R and also because those passageways have a larger cross-sectional area.

During tripping, however, the primary and secondary effects are in opposition, with the primary (direction of rotation) effect tending to cause a larger flow rate through the second (smaller-area) passageways 18, but with the secondary (area) effect tending to cause a larger flow rate through the first passageways 16. The stabilizer 10 has been designed so that the primary effect dominates during tripping, i.e. the tendency for a larger proportion of the mud to flow along the second passageways 18 because they face the direction of rotation R more than overcomes the smaller cross-sectional area of those passageways.

The stabilizer designer can choose the cross-sectional areas of the first and second passageways (and therefore their relative areas) and can also adjust the helix angles $\alpha$ and $\beta$, in order to influence the primary (direction of rotation) and secondary (area) effects.

Whilst reference is made above to the volumetric flow rate of mud along the respective passageways, it is the flow velocity along the passageways which is important in determining the stabilizer performance and which the inventors are seeking to better control. The average velocity of the mud flow along a respective passageway (i.e. ignoring localized velocity changes due to turbulence) will depend upon the volumetric flow rate along that passageway and the cross-sectional area of the passageway. Because of their larger cross-sectional area, the first passageways 16 can accommodate the larger flow rate during drilling more readily than the smaller passageways 18 can accommodate the larger flow rate during tripping. This results in the flow velocity of drilling fluid along the first passageways 16 during drilling being significantly lower than the flow velocity along the second passageways 18 during tripping.

Alternatively stated, if the total volumetric flow rate along the first passageways 16 is 30% greater (for example) than the total volumetric flow rate along the second passageways 18 during drilling, then because of their differing cross-sectional areas the relative flow velocities will differ by less than 30% (and the flow velocities would be equal if the cross-sectional areas differed by 30% in this example). However, during tripping if the total flow rate along the second passageways is 30% greater than the total flow rate along the first passageways, then the flow velocities will differ by more than 30%.

The fluid flows along the first and second passageways 16, 18 meet and mix at the intersections 20 and the intersecting flows induce turbulence at the intersections, which turbulence acts to mobilize the solids within the fluid (and/or to help sustain the mobilization of the solids). In general, higher flow velocities, and a greater difference in the relative flow velocities along the respective passageways 16, 18, will induce more turbulence at the intersections.

From the above it will be understood that the stabilizer 10 can provide a relatively low flow velocity, and a small difference in relative flow velocities along the respective passageways 16, 18, during drilling. This has been found to minimize the likelihood of turbulence within the mud and thereby to reduce the likelihood of downhole vibrations caused (or sustained) by such turbulence. Vibration is not a significant concern during tripping, however, and the large difference in relative flow velocities and the high flow velocity which the stabilizer 10 can provide maximizes turbulence in the drilling fluid and minimizes the likelihood of settlement of the solids during tripping.

Figure 3:
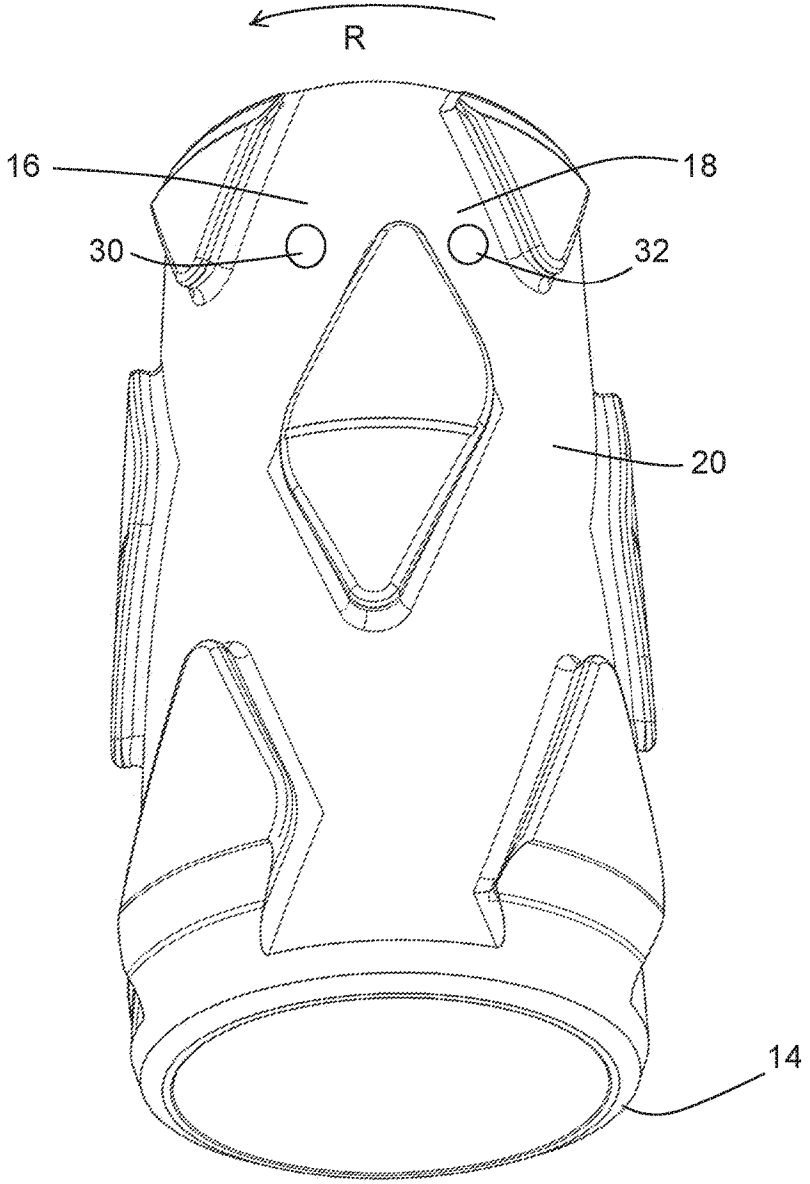
FIG. 3 shows another perspective view of the stabilizer.

Another positive attribute of the stabilizer 10 is described in relation to FIG. 3, which represents a somewhat artificial situation in which solids have settled in the regions 30 and 32, region 30 being within a first passageway 16 and region 32 being within a second passageway 18. As with a conventional stabilizer, the solids in region 30 are driven uphole as the stabilizer 10 rotates in the direction R (similar to the way in which an Archimedes screw can lift material). It will be understood that with a conventional stabilizer having only clockwise passageways these solids are continually pushed uphole on top of the stabilizer, building in quantity and increasing the likelihood of a pack-off.

The solids in region 32 are, however, driven downwardly as drawn (i.e. towards the drill bit) to the intersection 20. The turbulence at the intersection 20 will mobilize the solids and allow them subsequently to be carried uphole. Also, with the present invention the solids in region 30 will firstly move towards the top of the stabilizer 10 but will then move downwardly along the second passageway 18 as do the solids in region 32, subsequently becoming mobilized at the intersection 20. It will similarly be understood that any solids immediately above the stabilizer 10 during tripping will tend to enter one of the passageways 18 facing the direction of rotation, and then be mobilized at an intersection 20.

FIG. 3 also shows that if a passageway becomes totally blocked by solids (for example by an enlargement of the region 32), there are (multiple) alternative flow paths along which mud can continue to flow to the surface.

Figure 2:
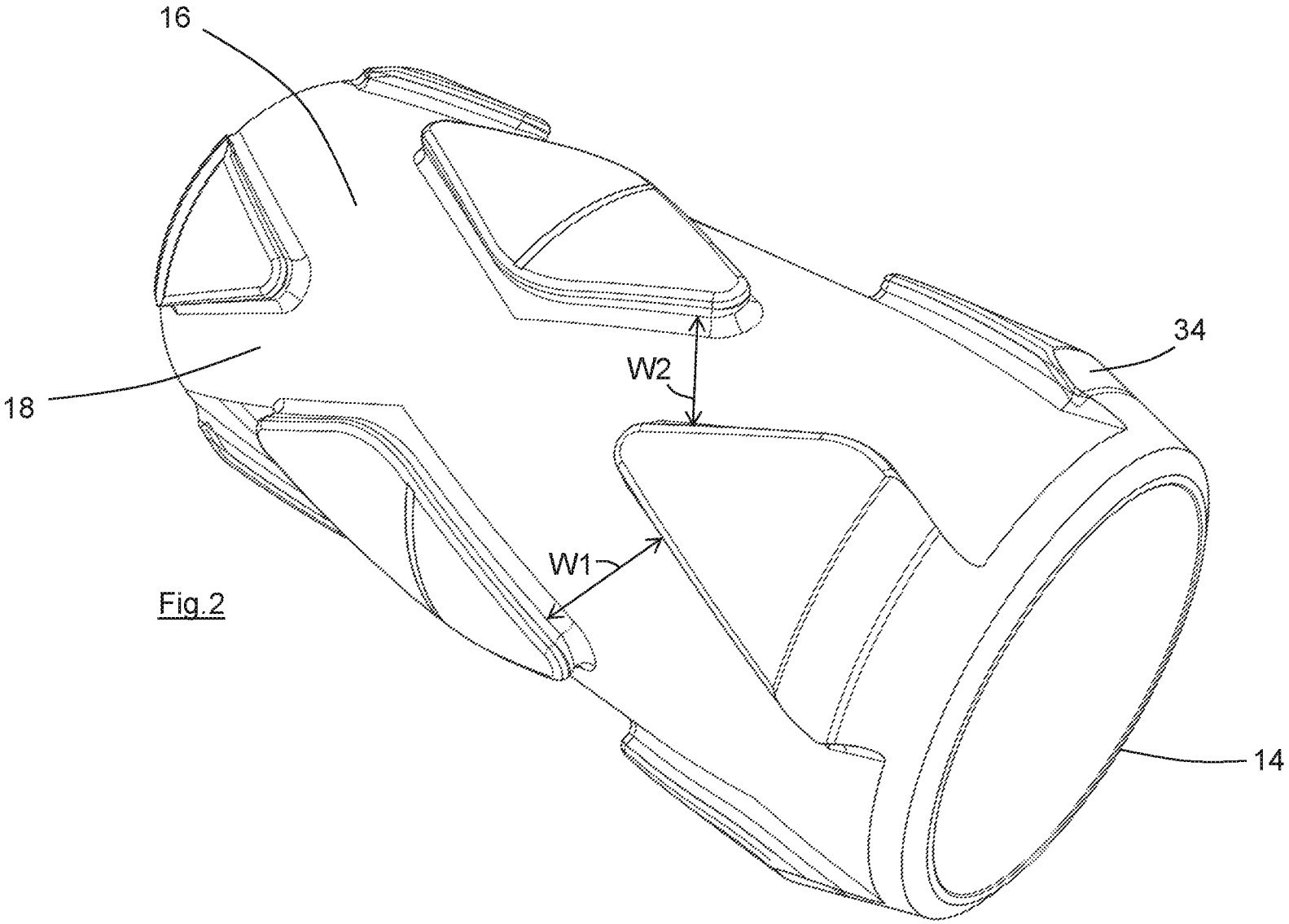
FIG. 2 shows a perspective view of the stabilizer.

FIG. 2 shows that the truncated ends 34 of the blades 20 are chamfered. The chamfer reduces the likelihood that the stabilizer will become stuck on an obstacle within the borehole. However, the chamfer might also act to push solids radially outwards into the small clearance gap between the blade and the borehole wall. It is not desirable to push solids into the clearance gap, especially drill cuttings which might be of significant size. To reduce the likelihood of this, in an alternative embodiment the truncated ends of the blades are tapered and present a sharp leading end. A sharp leading end will increase the likelihood that the solids are driven (sideways) towards the first or the second passageway rather than outwardly towards the clearance gap.

The open area of the periphery of the stabilizer 10, i.e. the proportion of any cross-section of the periphery which comprises a passageway 16, 18 rather than a blade 22, is at least 50%, and ideally is around 60%.

It has been found that a drill string including a stabilizer 10 can tripped without rotation, i.e. the fluid flow passageways 16, 18 are sufficiently large and numerous to provide clear flow paths for the drill cuttings without rotation, which is not possible with the known stabilizers.

The invention claimed is:

1. A stabilizer for a steerable drilling system, the stabilizer having a first helical passageway and a second helical passageway at an outer surface of the stabilizer, the first and second helical passageways extending from a first end of the stabilizer to a second end of the stabilizer, the first helical passageway being oriented in one of a clockwise and an anticlockwise direction along the stabilizer from the first end to the second end and the second helical passageway being oriented in the other of the clockwise and anticlockwise directions along the stabilizer from the first end to the second end, the first and second helical passageways intersecting one another, the stabilizer having a number of blades between the first helical passageway and the second helical passageway, the first helical passageway having a first cross-sectional area between adjacent blades, the second helical passageway having a second cross-sectional area between adjacent blades, the first cross-sectional area being larger than the second cross-sectional area.

2. The stabilizer according to claim 1 in which the first helical passageway has a first depth and the second helical passageway has a second depth, and in which the first and second depths are substantially identical.

3. The stabilizer according to claim 2 in which the first helical passageway has a first width between adjacent blades, and in which the second helical passageway has a second width between adjacent blades, and in which the first width is between approximately two and three times larger than the second width.

4. The stabilizer according to claim 1 in which the first helical passageway has a first width between adjacent blades, and in which the second helical passageway has a second width between adjacent blades, and in which the first width is between approximately two and three times larger than the second width.

5. The stabilizer according to claim 1 in which the blades overlap to provide a 360° stabilizer circumference.

6. The stabilizer according to claim 1 in which the first helical passageway has a first helix angle and the second helical passageway has a second helix angle.

7. The stabilizer according to claim 6 in which the first and second helix angles have a same magnitude.

8. The stabilizer according to claim 1 in which the first passageway is oriented in the clockwise direction.

9. The stabilizer according to claim 1 in which side walls of the blades at ends of the stabilizer taper towards each other.

* * * * *